US007308864B1

(12) United States Patent
Catner

(10) Patent No.: US 7,308,864 B1
(45) Date of Patent: Dec. 18, 2007

(54) WARNING FLAG ASSEMBLY FOR USE WITH ELONGATED LOADS ON A ROADWAY VEHICLE

(76) Inventor: Anthony J. Catner, 6710 Pontiac Trail, South Lyon, MI (US) 48178

( * ) Notice: Subject to any disclaimer, the term of this patent is extended or adjusted under 35 U.S.C. 154(b) by 0 days.

(21) Appl. No.: 11/494,328

(22) Filed: Jul. 27, 2006

(51) Int. Cl.
*G09F 17/00* (2006.01)

(52) U.S. Cl. ..... 116/173; 116/28 R; 116/209; 40/590; 40/591; 428/4; 428/31

(58) Field of Classification Search ..... 116/173, 116/28 R, 35 R, 209, 30, 1, 200, 264, DIG. 7, 116/DIG. 17, DIG. 24; 40/588, 590, 591, 40/602, 612, 615, 616, 617, 642.02, 675, 40/660, 661.05, 661.08, 661.11, 661.12; 428/4, 31, 5, 7, 32, 36.3, 136; 73/170.07, 73/170.05

See application file for complete search history.

(56) References Cited

U.S. PATENT DOCUMENTS

| | | | | | |
|---|---|---|---|---|---|
| 1,535,844 | A | | 4/1925 | McLemore | |
| 1,579,034 | A | | 3/1926 | Roberts | |
| 1,685,080 | A | | 9/1928 | Auchincloss | |
| 1,742,574 | A | | 1/1930 | Breedlove | |
| 1,787,150 | A | | 12/1930 | Gerow et al. | |
| 1,819,768 | A | | 8/1931 | Coffing | |
| 1,893,303 | A | | 1/1933 | Philips | |
| 1,893,585 | A | | 1/1933 | Hogan | |
| 2,101,163 | A | | 12/1937 | Wolfe | |
| 2,166,520 | A | * | 7/1939 | Challoner | 116/30 |
| 2,243,618 | A | | 5/1941 | Brown | |
| 2,506,197 | A | * | 5/1950 | Burger | 74/551.8 |
| 2,802,443 | A | | 8/1957 | Hanson | |
| 2,975,401 | A | | 3/1961 | Shupe | |
| 3,041,580 | A | | 6/1962 | Bos | |
| 3,080,581 | A | | 3/1963 | Smihal | |
| 3,209,722 | A | | 10/1965 | Thomsen | |
| 3,457,134 | A | * | 7/1969 | Karkoska | 428/4 |
| 3,560,313 | A | * | 2/1971 | Herkimer | 428/4 |
| 3,678,456 | A | | 7/1972 | Gruber | |
| 3,678,886 | A | | 7/1972 | Tibbet | |
| 3,791,337 | A | * | 2/1974 | Schamblin | 116/28 R |
| 4,162,100 | A | | 7/1979 | Muscillo | |
| 4,201,806 | A | * | 5/1980 | Cole | 428/4 |
| 4,309,836 | A | | 1/1982 | Knapp | |
| 4,558,862 | A | * | 12/1985 | Kelly | 473/176 |
| 4,622,494 | A | | 11/1986 | Johnson | |
| 4,624,648 | A | * | 11/1986 | Waters | 446/176 |
| 4,646,673 | A | | 3/1987 | Fordyce | |
| 4,860,477 | A | * | 8/1989 | Gooch | 40/603 |
| 4,881,485 | A | * | 11/1989 | Feinberg | 116/28 R |
| 4,958,436 | A | | 9/1990 | Tusche | |
| 4,980,984 | A | | 1/1991 | Kulp et al. | |
| 4,999,938 | A | | 3/1991 | Behling | |
| 5,028,031 | A | | 7/1991 | Stoudt | |
| 5,055,326 | A | * | 10/1991 | Whitington | 428/4 |

(Continued)

*Primary Examiner*—Diego Gutierrez
*Assistant Examiner*—Amy R. Cohen
(74) *Attorney, Agent, or Firm*—Brooks Kushman P.C.

(57) ABSTRACT

A warning flag assembly is disclosed for attachment to an overhanging load on a roadway vehicle. The flag assembly is generally cylindrical and has one margin secured to a holder that may be releasably attached to the overhanging load using conventional hardware whereby the flag assembly can be used with a variety of loads, re-used and conveniently stored when not in use.

1 Claim, 2 Drawing Sheets

U.S. PATENT DOCUMENTS 5,079,046 A * 1/1992 Kessler ..... 428/4
5,088,439 A 2/1992 Anderson
5,134,385 A 7/1992 Coleman
5,152,091 A 10/1992 Leach
5,161,769 A * 11/1992 Coulthard ..... 248/599
5,215,346 A 6/1993 Reitzloff et al.
5,234,725 A * 8/1993 Smith ..... 428/4
5,319,967 A * 6/1994 Rickards, Jr. ..... 73/170.06
5,365,685 A 11/1994 Shank
5,403,219 A 4/1995 Ryan
5,423,281 A 6/1995 Crookham et al.
5,450,058 A 9/1995 Collier
5,481,244 A 1/1996 Dicke
D369,310 S * 4/1996 Hanson ..... D10/109
5,685,255 A * 11/1997 Arzu ..... 116/30
5,979,355 A 11/1999 LeBlanc
6,032,908 A 3/2000 Hillstrom et al.
6,672,243 B2 * 1/2004 Seymour et al. ..... 116/28 R
6,789,496 B2 * 9/2004 Gehris ..... 116/173
7,178,280 B1 * 2/2007 Passmore ..... 40/591

* cited by examiner

WARNING FLAG ASSEMBLY FOR USE WITH ELONGATED LOADS ON A ROADWAY VEHICLE

BACKGROUND OF THE INVENTION

1. Field of the Invention

The invention relates to a warning flag and flag carrier assembly for use with loads carried by a roadway vehicle.

2. Background Art

It is a known practice to use warning flags for use on roadway vehicles with over-length loads. The flags are used to satisfy statutory requirements that apply to loads that protrude beyond the rearward extremity of a roadway vehicle, such as a truck. Warning flags are required if a load protrudes from the rear of the vehicle beyond a specified length, but it is desirable and prudent from a safety standpoint to use warning flags on extended loads even if the statutory overhang load limit is not exceeded.

It is preferable to use warning flags that are readily attachable to an extended load and to the design warning flag assembly so that it can be reused easily and easily stored when it is not in use. Known warning flag assemblies have been disclosed in prior art patents such as U.S. Pat. Nos. 5,979,355 and 3,678,886, which are representative of the prior art relating to the present invention.

The design disclosed in the '355 patent comprises an array of individual flags mounted on individual supporting staffs that extend in a generally radial direction with respect to the longitudinal axis of an extended load. Each flag staff is secured to a load by a radial screw that extends through a metallic anchor ring. The screw is threaded into the load, such as a wooden pole extending beyond the rearward extremity of a highway truck. The design of the '355 patent is specifically intended to be used with a utility truck that transports wood utility poles. It is not feasible for use with other types of loads that overhang the rearward extremity of a roadway vehicle. Further, the metallic ring must be adjusted to accommodate the circumference of the utility pole, which is non-uniform. A design such as that disclosed in the '355 patent, furthermore, cannot readily be stored when the flag is not in use because of the complexity of the design. It also requires the use of specialized parts that are not readily available to a trucker in normal hardware retail outlets. The requirement for specialized hardware in the design of the '355 patent may present a cost penalty that would discourage its widespread use with overhanging loads other than utility poles.

The design of the '886 prior art patent, like the design of the '355 patent, also is intended for use only with a specialized class of loads, such as utility poles and logging truck loads. The design has limited versatility because of the requirement for a chain-like band to which a hem of a warning flag can be attached. The band comprises multiple links, the ends of the band having metallic hooks for securing together the ends of the band after the band encircles a load, such as a power line pole. Band links can be added or eliminated by using fastening members that extend through eyelets formed at the ends of each link of the band. Again, the versatility of the warning flag of the design shown in the '886 patent is limited and it requires the use of specialized hardware.

It is an objective of the present invention to provide a warning flag assembly of simplified construction and that is readily useable on any type of load without the use of specialized hardware and that is readily reusable. The flag will draw the attention of drivers of other vehicles on the highway to the overhanging load because of the high visibility of the flag. It is a further objective to provide a warning flag assembly that can readily be attached to an overhanging load and readily detached and stored. It is a further objective of the invention to provide a warning flag assembly for overhanging loads on roadway vehicles wherein the assembly consists of readily available hardware, and wherein the assembly can be manufactured with minimal cost.

SUMMARY OF THE INVENTION

The invention comprises a warning flag assembly that comprises a flag of red, light-reflective material, such as nylon. The light-reflective material comprises multiple streamers that extend from a solid portion of the nylon material. According to one embodiment of the invention, the nylon material can be rolled and the solid portion of the nylon material can be inserted in a cylindrical body, preferably a cylindrical body made of plastic (e.g., PVC). After the material is rolled and inserted in the plastic body, the material can be secured by a cross-pin extending in a diametrical direction through the plastic body. The cross-pin provides an anchor for an eye hook that can be secured to a connecting wire loop that can encircle a load such as a ladder, a scaffold, a pick, or the like. If the load is rough lumber or wood planks, etc., the eye hook can be attached to a companion threaded eye hook that readily can be threaded into the load by a trucker using a manual twisting torque. If the load comprises a finished molding or a pipe or finished furniture, for example, that does not lend itself to the use of a threaded eye hook, a simple spring clamp with an opening for receiving an eye hook can be used instead to secure the flag assembly to the load.

An alternate embodiment of the invention includes a flag made of red, light-reflective material similar to the red, light-reflective material used in the first embodiment, which includes a solid portion and streamers that extend from the solid portion. In the case of the design of the second embodiment, the solid portion can be secured to a rigid ring by stitching or by other attachment methods. If the red, light-reflective material includes a heat formable ingredient, heat sealing of the margin of the flag may be used to form a hem through which a metal ring would extend, although stitching could be used as well. Cables such as steel cables can be welded or otherwise secured to the rigid ring. The cables extend from the ring, and the ends of the cables can be secured to an eye hook of the type described with reference to the preceding embodiment. A connecting wire over a threaded eye hook or a spring clamp, described previously with respect to the preceding environment, also could be used.

BRIEF DESCRIPTION OF THE DRAWINGS

FIG. 1*d* is a perspective view of the tube that receives the flag material in the embodiment of FIG. 1;

DETAILED DESCRIPTION OF THE EMBODIMENTS OF THE INVENTION

Figure 1:
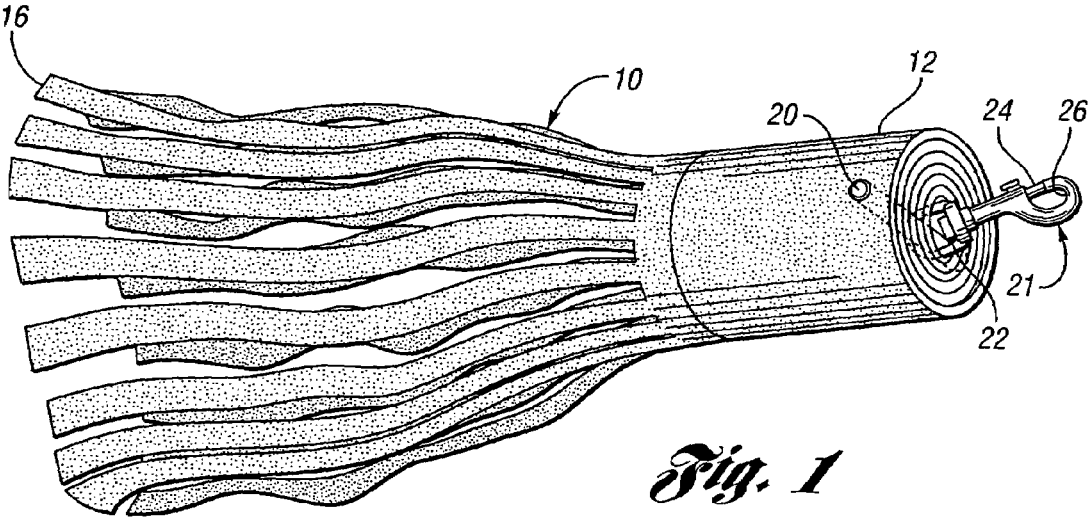
FIG. 1 shows a flag assembly according to the first embodiment of the invention wherein the flag material is rolled and inserted in a cylindrical tube.

FIG. 1 is an overall isometric assembly view of a first embodiment of the invention. It comprises a flag which may be made of red reflective nylon material as indicated at 10. The flag is illustrated in an unwrapped form in FIG. 1*e*. One margin of the flag is received in a rigid cylindrical holder body 12, which is indicated in detail in FIG. 1*d*.

The flag 1*e* comprises a solid portion 14 at one end of the flag and a cut portion 16 at the opposite margin of the flag. The cut portion 16 comprises parallel streamers 16 that extend from the lower margin of the flag for a distance B. The solid portion, as seen in FIG. 1*e*, extends from the upper margin for a distance A, which may be about 20% of the total length of the flag.

Figure 1A:
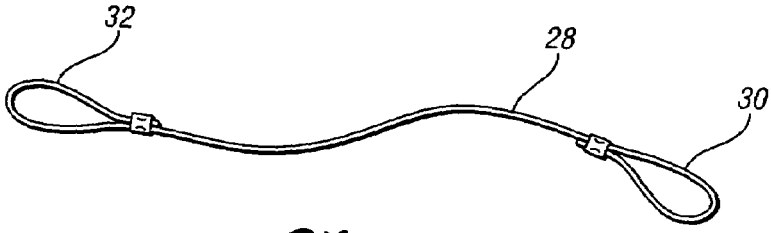
FIG. 1*a* shows a connecting strap or wire loop for use with the assembly of FIG. 1.
Figure 1C:
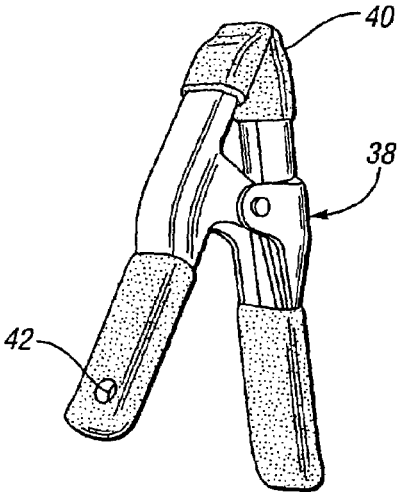
FIG. 1*c* shows a spring clamp that can be used with the embodiment of FIG. 1.
Figure 1B:
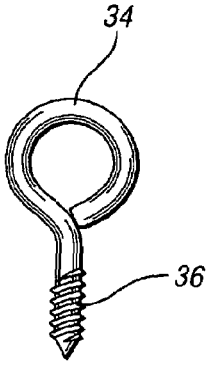
FIG. 1*b* shows a threaded eye hook that can be used with the embodiment of FIG. 1.
Figure 1B:
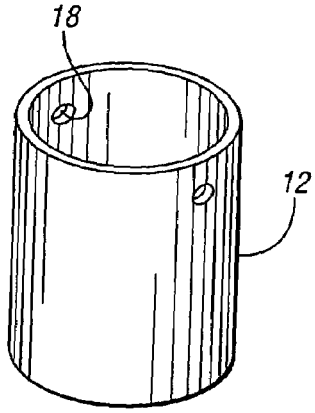
Figure 1E:
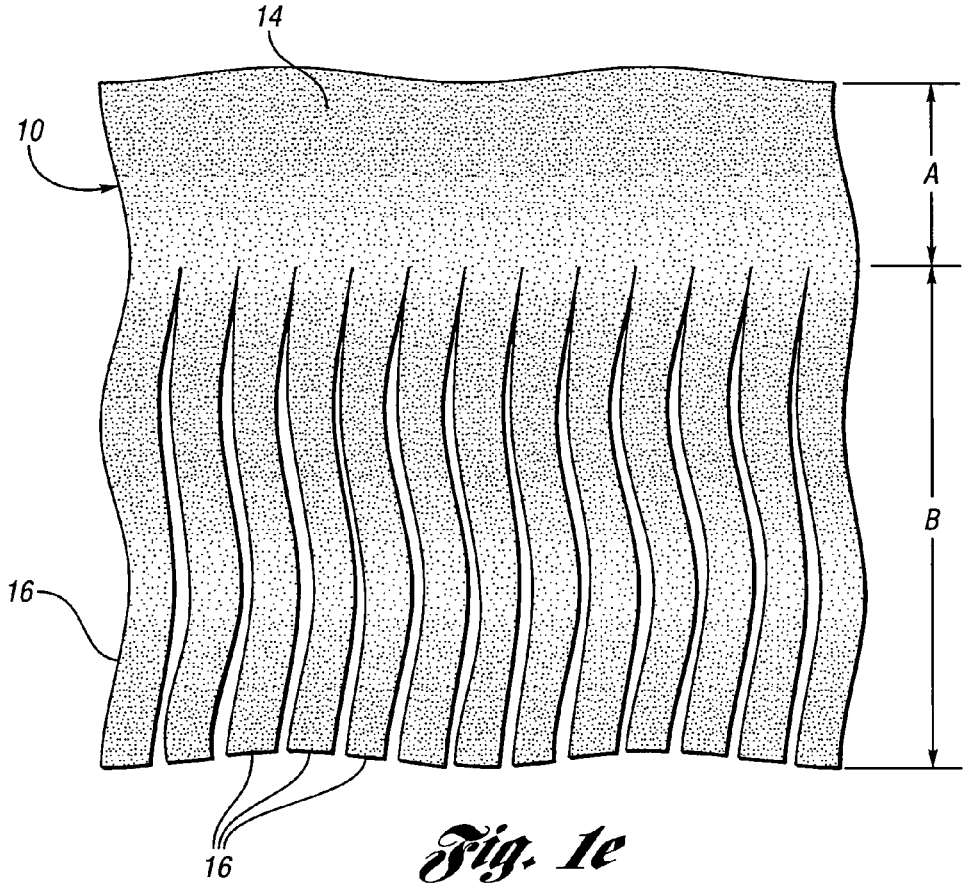
FIG. 1*e* shows an unwrapped flag illustrating the solid portion and the streamer portion.

As seen in FIG. 1, the flag seen in FIG. 1*e* is rolled into multiple layers so that the solid portion 14 defines a generally cylindrical shape so that it can be inserted into the cylindrical holder body 12. The longitudinal dimension of the holder body 12 may be approximately the same as the distance A indicated in FIG. 1*e*.

Holder body 12 is provided with two apertures 18 located approximately diametrically, one with respect to the other. A holder pin 20 is received in the openings 18. As indicated in FIG. 1, the pin 20, which may be made of zinc or other suitable metal, extends through the rolled solid portion 14 of the flag 10 thereby securing the flag 10 within the holder 12. The pin may be formed with a pointed end (not shown) so that it can perforate the folds of the solid portion 14 of the flag 10. The pin 20 can be secured in the openings 18 in any suitable fashion, such by a force fit or by staking the ends of the pin after the pin is inserted through the openings and through the nylon material.

The holder body 12 can be formed of plastic material, such as polyvinyl chloride, or it may be a metallic cylinder of sufficient rigidity to maintain the flag securely after the solid portion 14 of the flag is inserted in the holder body.

A conventional latch hook 21 can be used to provide a means for attaching the assembled flag and holder body to a load. The latch hook can include a loop 22 at one end that surrounds the pin 20. Opposite end of the latch hook 21 can be provided with a spring clasp 24 to provide a closed eyelet 26.

A strap or wire loop 28, as seen in FIG. 1*a*, may be used to loop around a load that overhangs the end of a roadway vehicle. The strap or wire loop 28 may be provided with end loops 30 and 32 that can be received in the eyelet 26 of the latch hook 21. One end of the strap or wire loop 28 can be inserted through the eyelet at the other end, and the one end then can be received in the eyelet 26 of the latch hook 21. In the alternative, both end loops 30 and 32 can be inserted in the eyelet 26.

The latch hook 21 can be secured to a threaded eyelet 34 as seen in FIG. 1*b*. The eyelet 34 includes a threaded portion 36 that can be threaded manually into a pole or other load of wood carried by a roadway vehicle. If the load should not be penetrated with a threaded eyelet such as that shown in FIG. 1*b*, a spring loaded clamp 38 can be used. Preferably the clamp 38 includes plastic or rubber tips 40. One of the arms of the clamp 38 can be provided with an opening 42 for accommodating a connection between the clamp 38 and the latch hook 21.

Figure 2:
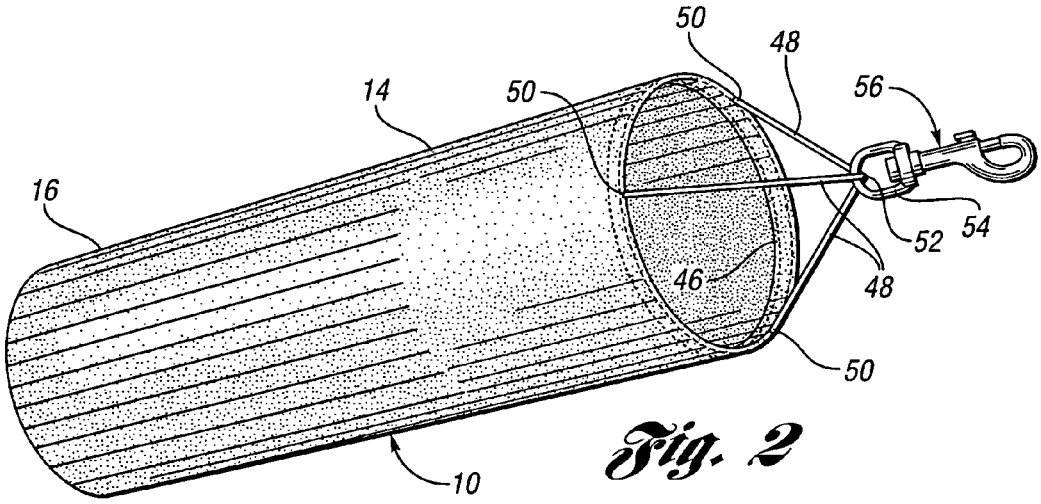
FIG. 2 is an assembly view of a second embodiment of the invention wherein the flag material is secured to a ring.
Figure 2A:
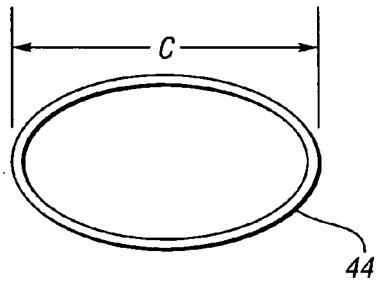
FIG. 2*a* is a detailed view of the ring used in the embodiment of FIG. 2.

An alternate embodiment of the invention is illustrated in FIG. 2. It comprises a rigid holder, endless ring 44, which may be made of metal or other rigid material. The flag 14 can be rolled around the ring 44, which may have a circular shape with a diameter C. As indicated in FIG. 2, the right hand edge 46 of the flag 14 can be wrapped around the holder ring 44 and stitched in place. In the alternative, heat sealing can be used rather than stitching if the material of which the flag is made includes a sealing ingredient.

A plurality of connecting elements, such as cables 48, preferably three in number, can be welded or otherwise secured, as shown at 50, to the ring 44 at angularly spaced locations. The extended ends of the cables 48 can be joined as indicated at 52, preferably by welding, and an eyelet 54 of a conventional latch hook 56 can be secured to the joined ends of the cables 48. The latch hook 56 may be identical to the latch hook 21 of FIG. 1.

The warning flag of either embodiment, when attached to an overhang load on a roadway vehicle, will draw the attention of the drivers in following vehicles. The flag is reusable for different loads and it is easily secured to a load in such a way that it will not become detached during transportation of the load. Visibility at night can be enhanced by applying light reflective material to the streamers 16.

The same warning flag can be used on a variety of loads regardless of whether the load comprises lumber or extended planks, or loads having finished surfaces, such as furniture. This is done by choosing the appropriate hardware, which may comprise the spring loaded clamp of FIG. 1*c*, or the threaded eyelet of FIG. 1*b*, or the strap of FIG. 1*a*. Versatility in the use of the warning flag thus is provided. Other conventional hardware could be used if desired as well depending upon the circumstances.

Although embodiments of the invention have been disclosed, it will be apparent to persons skilled in the art that modifications may be made without departing from the scope of the invention. All such modifications and improvements thereof are intended to be covered by the following claims.

What is claimed is:

1. A warning flag assembly for installation on an overhanging load on a roadway vehicle comprising:

a flag of flexible flag material having a first margin that is solid and continuous and a second margin opposite the first margin, the second margin being discontinuous and defining streamers extending from the first margin;

the flag material being a red, light-reflective material;

the first margin being rolled to define generally circular, overlapping layers;

a hollow, rigid holder for the flag material;

the overlapping, rolled layers forming a solid cylindrical end of the flag assembly, the diameter of the cylindrical end being sized with a diameter smaller than an inner diameter of the hollow, rigid holder;

the rolled first margin of the flag material being inserted in the hollow holder;

a cross-pin extending transversely through the holder and through the flag material; and a fastener having one end secured to the cross-pin, the other end of the fastener being adapted to be connected to the overhanging load.

* * * * *